US007927007B2

(12) United States Patent
Della Casa

(10) Patent No.: US 7,927,007 B2
(45) Date of Patent: Apr. 19, 2011

(54) ROLLER-TYPE SPRAYER-MIXER FOR SPRAYING AND MIXING FLUIDS

(76) Inventor: Luigi Pietro Della Casa, Padula Scalo (IT)

( * ) Notice: Subject to any disclaimer, the term of this patent is extended or adjusted under 35 U.S.C. 154(b) by 842 days.

(21) Appl. No.: 11/886,706

(22) PCT Filed: Apr. 14, 2005

(86) PCT No.: PCT/IT2005/000215

§ 371 (c)(1),
(2), (4) Date: Sep. 19, 2007

(87) PCT Pub. No.: WO2006/109336

PCT Pub. Date: Oct. 19, 2006

(65) Prior Publication Data

US 2008/0165614 A1 Jul. 10, 2008

(51) Int. Cl.
*B01F 7/20* (2006.01)

(52) U.S. Cl. ..... 366/301; 366/245

(58) Field of Classification Search ..... 366/245, 366/288, 301

See application file for complete search history.

(56) References Cited

U.S. PATENT DOCUMENTS

| | | | | |
|---|---|---|---|---|
| 20,025 | A * | 4/1858 | McNish | 99/462 |
| 2,650,804 | A | 9/1953 | Marco | |
| 3,094,828 | A | 6/1963 | Payne et al. | 55/407 |
| 3,166,301 | A * | 1/1965 | Wootten | 366/169.2 |
| 3,722,831 | A | 3/1973 | Bialas et al. | |
| 3,734,401 | A | 5/1973 | Frewen | 233/20 |
| 6,177,052 | B1 | 1/2001 | Weichs et al. | |
| 7,591,882 | B2 | 9/2009 | Harazim | 95/270 |

FOREIGN PATENT DOCUMENTS

| | | |
|---|---|---|
| DE | 10035055 | 1/2002 |
| EP | 0745418 | 12/1996 |
| FR | 2535216 | 5/1984 |
| WO | 2004/050255 | 6/2004 |

OTHER PUBLICATIONS

PCT International Preliminary Report on Patentability for PCT/IT2004/000377 filed on Jul. 8, 2004 in the name of Luigi P. Della Casa.

PCT International Search Report for PCT/IT2004/000377 filed on Jul. 8, 2004 in the name of Luigi P. Della Casa.

PCT Written Opinion for PCT/IT2004/000377 filed on Jul. 8, 2004 in the name of Luigi P. Della Casa.

Office Action issued by USPTO for U.S. Appl. No. 11/630,286 dated Apr. 29, 2010.

PCT International Preliminary Report on Patentability for PCT/IT2005/000215 filed on Apr. 14, 2005 in the name of Luigi P. Della Casa.

PCT International Search Report for PCT/IT2005/000215 filed on Apr. 14, 2005 in the name of Luigi P. Della Casa.

PCT Written Opinion for PCT/IT2005/000215 filed on Apr. 14, 2005 in the name of Luigi P. Della Casa.

* cited by examiner

*Primary Examiner* — David L Sorkin
(74) *Attorney, Agent, or Firm* — Steinfl & Bruno LLP

(57) ABSTRACT

An apparatus for mixing and atomizing gases and liquids are described. The liquid is atomized by the combs of rollers that rotate in the chamber. The rollers are configured to neutralize centrifugal forces, thus preventing the liquid fluid from bordering the sides of the chamber, thus mixing the gas with the liquid.

19 Claims, 5 Drawing Sheets

ROLLER-TYPE SPRAYER-MIXER FOR SPRAYING AND MIXING FLUIDS

CROSS REFERENCE TO RELATED APPLICATIONS

The present application is the US national stage of International Application PCT/IT2005/000215, filed on Apr. 14, 2005, and may be related to International Application PCT/IT2004/000377, filed on Jul. 8, 2004, incorporated herein by reference in its entirety.

FIELD

This invention can be included in the category of atomizer, even though its main function is to very rapidly mix continuously flowing fluids. Besides, the use of atomizers is varied. As a matter of fact, they are used for many different purposes (purification, combustion, irrigation, etc.).

BACKGROUND

Most common atomizers work by nebulizing liquid compressed by a pump, and then forced through one or more injectors with a limited calibre, creating resistance to current. Upon exiting the injector, there is a sudden disappearance of the pressure around the liquid, which therefore explodes into micro-aggregates.

The following are systems that are apparently similar to ours, but which actually have a different function:

U.S. Pat. No. 3,722,831 granted on Mar. 27, 1973

U.S. Pat. No. 2,650,804 granted on Sep. 1, 1953

U.S. Pat. No. 6,177,052 B1 granted on Jan. 23, 2001

U.S. Pat. No. 3,722,831 is only a mixer and does not claim an atomizer function. The blades of the rotating rollers do not, or only slightly enter the circular range of action of the blades from the adjacent axes. When the fluid is in the circular inner area of the blades, and not reached by the blades of the adjacent axes, the blades move in a circular motion. This limits the disintegrating action of the blades and leads to the formation of an area free of liquid fluid inside the blades as a result of centrifugal force.

The marginalization of the fluid to the edges of the blades are described as a phenomenon necessary for the mixing process, with a "funnel-like movement" of the material, which means that there is an accumulation on the outside and a rarefaction on the inside of the areas of rotation. Claim 3 mentions the overlapping of the circumferences described by the outer edges of the instruments housed in adjacent containers. As one can see from the drawings, the overlapping part is only a tiny percentage of the radius of the blades (see FIGS. 1, 3 and 14). The forced passage of a gas at a speed higher than the speed of liquid, it would pass through an area with the least resistance, which is, precisely the internal area with little or no liquid fluid. In this manner, it would escape interaction with the liquid fluid. The circular motion induced by the blades drives the centrifugal force of fluid from one blade to the range of action of the adjacent blade, and vice versa. The friction between the two currents causes the mixing action, which is, precisely, the function claimed by this patent (see FIGS. 4-5).

Thus, no atomizing action takes place. The presence of the blades which are broad flat surfaces, suitably tilted facilitate the rotation of the fluid, represents an obstacle to a possible rapid and continuous axial current.

U.S. Pat. No. 2,650,804 specifically claims producing latex foam. In this device, the claimed and effective function is that of a mixing machine. There is no real atomizing action. In fact, this action is neither claimed nor described. The problem of the need for a gaseous current to rapidly flow through the foam and interacting is not even taken into consideration.

One can find two coaxial rotors with four arms distributed in a cross shape at the ends of the axes by joining the corresponding ends of the two rotors which are placed longitudinally parallel to the direction of the flow of the mixture. The action of these axes is translated into a linear slashing action, parallel to the current. Such action tends to generate columns of fluid, separated only longitudinally. Transversal slashing action cannot cause a repeated fragmentation of fluid flowing perpendicularly. The level of nebulization obtained in this manner would be very limited. In the modified form (see FIGS. 51-65, and 71-72), similarly to the present disclosure, are rollers with rods perpendicular to their longitudinal axis, and therefore perpendicular to the flow. It is necessary, however, to point out that the only roller that rotates in an active and synchronous manner with the traction with the crosses is the central roller (see column 10, lines 14-16).

The transmission with gears (see FIGS. 26-27) are used between two or more functional units, each equipped with a central axis that rotates with the crossed arms and some peripheral axes that are free on the arms. Two functional units are joined in FIGS. 71-72. The two, three or four (depending on the version) peripheral rollers ((38) on drawing page 15; (28) on drawing page 16; (48) on drawing page 17; (54) on drawing pages 19 and 20) and the central roller ((33) on drawing page 15; (26) on drawing page 16; (43) on drawing page 17; (62) on drawing pages 19 and 20) rotate passively relative to the resistance opposed by the treated material. This is because they are inserted freely and not in a fixed manner in the blades of the rotor without any transmission of the driving force. The rotation of the peripheral rollers around their own axis due to the resistance posed by the viscosity of the treated material is related to the movement of the material in relation to the rotor. Subsequently, there is no active percussive action on the material, lacks the centrifugal drive necessary to contrast the action of the central roller in order to avoid driving denser fluids to the outside. Consequently, an atomizing action is impossible.

U.S. Pat. No. 6,177,052 B1 has similarities with the present disclosure, but there is no claim to an atomizing function, nor is this function taken into consideration as a necessary part of the procedure. The device in question does not have this functional characteristic. It is derived from the gas purifiers, in which the substance that needs to react with the gas is inserted in the reactor in the form of a dry powder or a damp powder. The possibility of inserting a saturated solution of the reagent in liquid fluid form is not considered. The addition of water is considered only in order to renew the dampness of the reactive powder and not for the formation of a liquid mixture.

There is a claim to the presence of flexible swirling elements on axes rotating parallel to one another. They produce the whirling movement in the gas mixture to be purified and of the reactive powder which may be preventively humidified.

The following are not claimed at all:

a) The need for the ends of the flexible elements to be as close as possible to the adjacent rotating axes.

b) The need to pass narrowly between two consecutive planes of the flexible elements of the adjacent axes including the two essential characteristics in order to avoid peripheral marginalization caused by the centrifugal force of the denser components, and therefore essential in order to avoid the separation of denser components from less dense components (gas), and generating the atomization of a liquid fluid in the presence of a gas.

c) The need to be set up in the greatest possible number of consecutive levels so that the mixture is struck, running along the reactor as frequently as possible.

d) The need for the elements to be sufficiently rigid, so that they do not bend when striking the non-nebulized liquid. Chains are mentioned in the patent in question.

Furthermore, they do not describe the need for a central axis surrounded by peripheral axes so as to cause the contrast of a central centrifugal force with peripheral centrifugal forces of the same entity as the central force. This avoids the tendency of the denser fluid, in case of a lack of a central axis, to occupy an area common to the ranges of action of the axes set up in a circle (see FIG. 2B in U.S. Pat. No. 6,177,052 B1). They evidently do not describe the need for a number of these peripheral axes to be six for the centrifugal forces to be the same.

The result causes a whirling motion in the powder in the presence of the gas, but not the nebulization in the presence of gas or liquid. Further, proof of their failure to consider the need to atomize a liquid fluid, is represented in the drawings on pages 4-6. In these drawings, the axes are not parallel, but perpendicular to the current. Thus, liquid fluid would accumulates at the bottom, allowing gas to flow through the area situated above without interaction.

The atomization function claimed in the present disclosure and not disclosed in the aforementioned patents associated with a mixing function is of fundamental importance since it allows for an significant increase in the surface area contact between the liquid fluid and the gaseous fluid, as well as the possibility for the gaseous fluid to flow rapidly between the particles of the nebulized liquid, thus driving them at the same time out of the nebulization chamber. The terms 'neubulization' and 'atomization' is used interchangeably herein in the present disclosure.

BRIEF DESCRIPTION OF DRAWINGS

The accompanying drawings, which are incorporated into and constitute a part of this specification, illustrate one or more embodiments of the present disclosure and, together with the description of example embodiments, serve to explain the principles and implementations of the disclosure.

DETAILED DESCRIPTION

Figure 1:
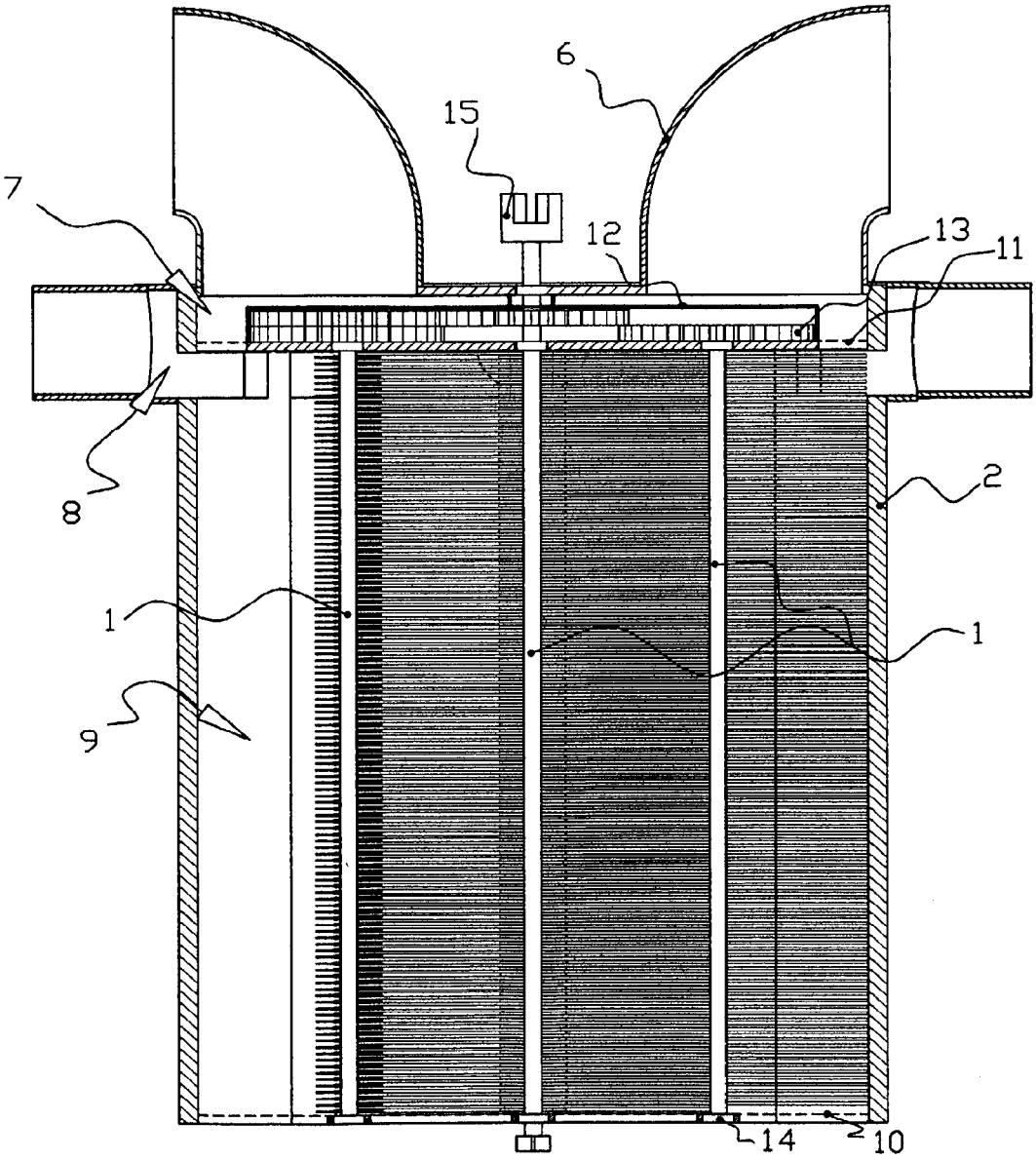
FIG. 1 shows a view of a longitudinal cross-section of the atomizer.
Figure 2:
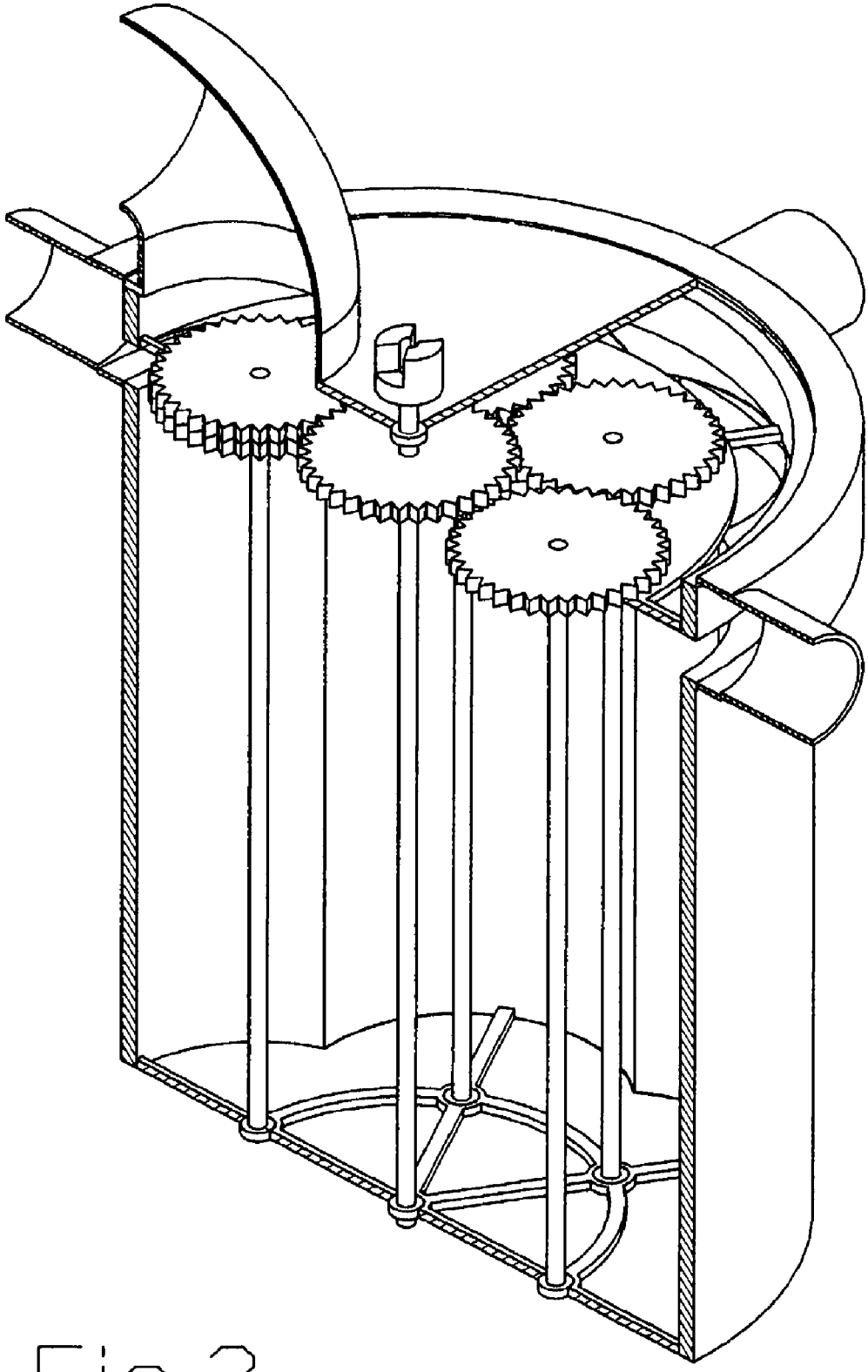
FIG. 2 shows an oblique axonometric view of a longitudinal cross-section of the atomizer without rollers or the sump, and a partial-cross section of the transmission and input compartment.
Figure 3:
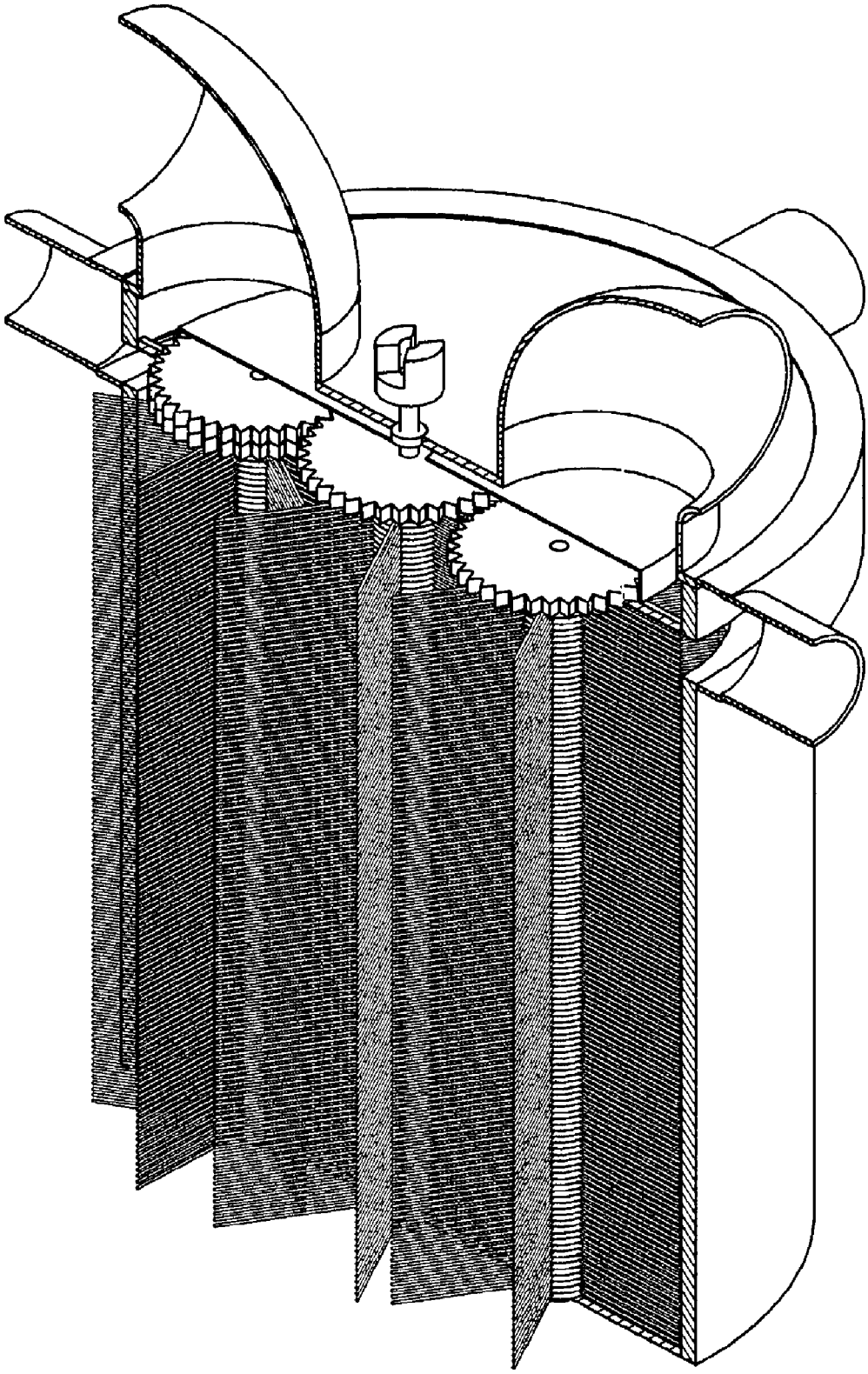
FIG. 3 shows an oblique axonometric view of a longitudinal cross-section of the atomizer with rollers.

The atomizer-mixer comprise: atomizer rollers (1) and a container body (2). The atomizer rollers further comprise: axial cylinders (3), rods (4), and discs (5). The container body comprise: input tubes (6), transmission and input compartment (7), collector (8), atomization chamber (9), support at rosette (10), windowed support (11), sump (12), gears (13), ball bearings (14), and transmission joint (15).

A minimum of seven atomizer rollers (1) are present and their longitudinal axes are parallel to each another. One atomizer roller (1) is arranged in the center (called central roller) and the other six rollers (called peripheral rollers) are arranged in a circular pattern around the first atomizer roller (1), at the vertexes of a hexagon inscribed in a reference circle, and equal distance from the center. This distance is equal to the distance between each of the atomizer rollers (1).

Each atomizer roller (1) is represented by a thin axial cylinder (3) on the surface of which there are thin rectilinear rods (4), all perpendicular to the longitudinal axis of the roller. These rods (4) are aligned along the same straight line for the entire length of the roller, creating a "comb". For each group of coplanar rods (4), there is a disc (5). On the upper and lower surfaces, the rods (4) are preferably serrated with cuts perpendicular to the longitudinal axis of the rod (4), which form thin parallel blades. The depth and number of the cuts are the largest possible number.

If the six peripheral atomizer rollers (1) are rigid, the rods (4) are arranged in six longitudinal rows (6 combs) to form six 60 degree angles on a plane perpendicular to the axis of the atomizer roller (1). At the same height as the rods (4) is a disc (5) of same thickness as the rods (4) with a radius shorter than the length of the rods (4). The length of the rods (4) can be determined by subtracting from the radius of the ideal circle (circle of reference), on which the axial center of the six rollers (1) are situated. 18.34% of the result of this measurement plus the radius of the axial cylinder (3) and slightly more than the thickness of a rod (4) (the hypotenuse of a right-angled triangle in which one side is equal to the thickness of a rod where one angle is 30 degrees). The thickness of the rods (4) should be as small as possible and their tips should be rounded.

The radius of the discs (5) are equal to the radius of the aforementioned circle minus the length of a rod (4) and the radius of the axial cylinder (3). The thickness is the same as the thickness of the rods (4). (If elastic rods are used, the number of combs used may be greater).

Figure 4:
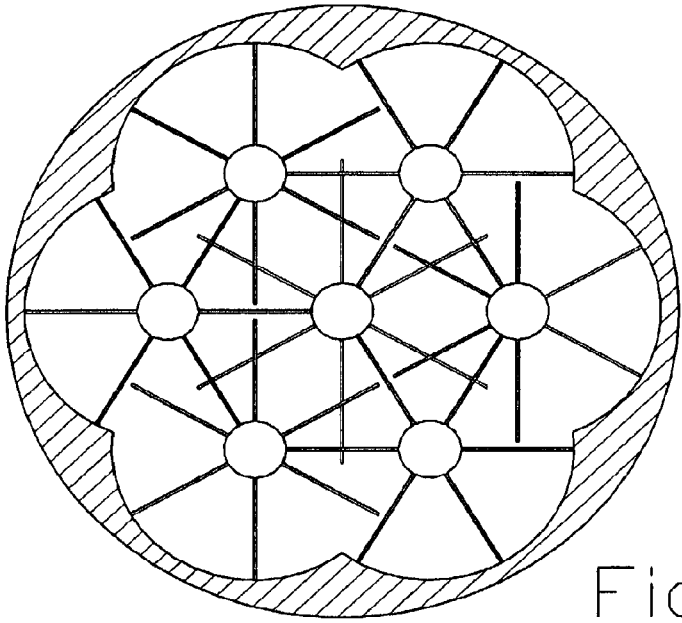
FIG. 4 show a top view of a transversal cross-section of the atomizer with the rosette support removed.
Figure 5:
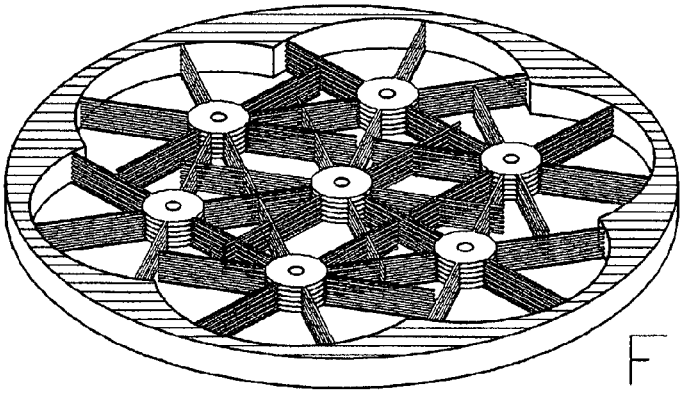
FIG. 5 show an oblique axonometric view of a slice of the atomizer chamber.
Figure 6:
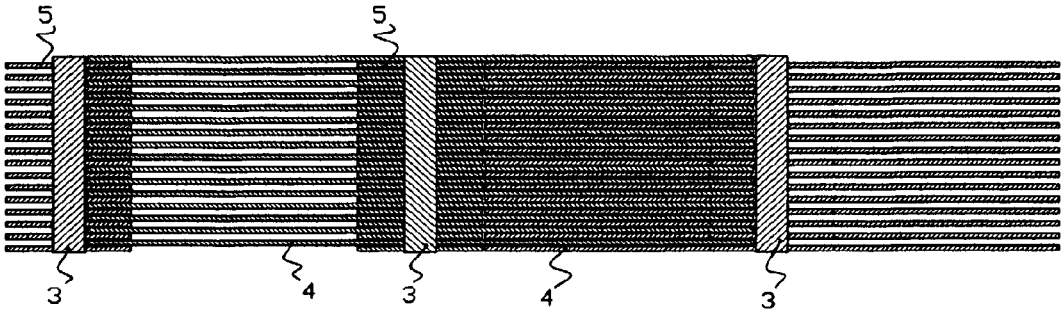
FIG. 6 shows a longitudinal cross-sectional view of the rollers.

The peripheral rollers (1) are orientated so that two combs on one roller (1) correspond to the center of the angle created by two adjacent combs of the two adjacent rollers (1) (see FIG. 4). The distance between one rod (4) and another rod following the roller (1) will be slightly larger than the thickness of a rod (4) so that one rod (4) can fit through the narrow space in question without friction. By taking these measures, the atomizer rollers (1) are able to rotate without the combs touching one another.

In the central roller (1) are also rods (4) and discs (5). The lengths of the rods (4) correspond to the radius of the reference circle minus the diameter of the axial cylinders (3) and enough to avoid contact with the peripheral rollers (1). The thickness will be the same as the thickness of the rods (4) on the peripheral rollers (1). The radius of the discs (5) will be the same as the radius of the discs (5) on the peripheral rollers (1). Their thicknesses will be the same or smaller. The rods (4) and the discs (5), unlike on the peripheral rollers (1), alternate longitudinally along the axis of the rollers (1).

The rods (4) will be set up along the longitudinal axis to match the spaces between the rods (4) on the peripheral rollers (1), through which they are capable of being able to pass without touching. The discs (5) will be coplanar with the rods (4) (and with the discs) on the peripheral rollers (1). There are six combs on the central roller (1). However, if elastic material is used, for example, in the peripheral rollers, there may be more combs.

In addition to propulsion of fluids external to the atomizer, the rods (4) can be inclined on the peripheral and central rollers (1), thus allowing the rollers to rotate suitably around their longitudinal axis. In such case, the rods (4) can be made in a laminar shape. This configuration creates a series of propellers on successive planes, which in turn produce, not only the atomization but also a driving force for the atomized mixture.

The inclination plane of rods on the peripheral propellers, between adjacent peripheral rollers (1) is reversed (left-handed and right-handed). The axial cylinders (3) of the rollers (1) are fixed to watertight ball bearings (14), positioned in supports (10,11) which are situated at the upper and lower ends of the nebulization chamber (9).

Alternatively, a fine mesh net with free saw-toothed edge can be used instead of the combs in such a way that the apex of the peripheral roller teeth (1) corresponds with the bottom of the interdental spaces of the central roller (1). A mesh net may be less effective but can be easier to manufacture.

This container body (2) comprises an atomization chamber (9) that has a cylindrical shape and contains six cylindrical cavities of equal diameters, all of which are parallel to the axis of the atomization chamber (9). The radius of the cylindrical cavities is equal to the sum of: 1) the length of the rods (4) on the peripheral rollers (1), 2) the radius of the axial cylinder (3), and 3) a space between the rods (4) and the walls of the cavities to avoid the rods (4) coming in contact with the walls. The center of the circle of reference corresponds with the center of the cylinder of the atomization chamber (9). Thus, the cavity looks like a single cavity with six half-circle arches, all coinciding at the center of the atomization chamber (9).

An input portion of the atomization chamber (9) comprises a windowed support (11) which fluidly communicates with the transmission and input compartment (7). Coinciding with arches on the wall are low and wide openings with an arched transversal cross-section, in communication with a ring-shaped collector (8). The top of end of the chamber (9) is a closed support in the central part, in which seven ball-bearings (14) are set, through which the axes of the seven rollers (1) pass to enter the transmission and input compartment (7). Outside this area, are openings that allow the fluid to enter the atomization chamber (9).

In the transmission and input compartment (7) are six gears connected to one another on the axes of the six peripheral rollers (1). A seventh gear is placed on top of the gear on one of the peripheral rollers (1) and is joined with a gear attached to the axis of the central roller (1) of the transmission joint (15). The gears (13) are protected by a sump (12) that allows the central transmission axis to pass through. Input tubes (6) are inserted on the roof of the compartment with a central watertight ball-bearing (14) for the transmission axis. The opposite end of the atomization chamber (9) is open, although there is a support (10) "at rosette", holding in place the seven ball-bearings (14) at the axes where the seven rollers (1) are inserted. This support (10) is made to leave open the largest possible surface even though it supplies gains for the ball-bearings (14).

A motor is used to translate the rotational motion from the rollers by way of the gears on the central roller and the associated six gears connected to one another. The peripheral gears will rotate in a direction opposite the adjacent peripheral gears will rotate. Thus, if one roller turns in one direction (e.g., counter-clockwise), the two adjacent rollers will rotate in the opposite direction (e.g., clockwise).

One of the fluids to be treated is inserted in the atomization chamber through the input tubes and though the transmission and input compartment (7). The other fluid(s) to be treated are inserted through the collector. The two or more fluids combine in the atomization chamber. The rollers atomize the liquid fluids by turning the combs which mixes with gaseous fluid to forms a foamy mixture. The pressure from above and/or the propeller-type conformation of the rods drive the foam down toward the bottom of the atomization chamber whereby the atomization and mixing process continues along the entire length of the atomization chamber.

At the exit portion of the atomizer, a centrifugal separator is inserted (see for example, PCT/IT2004/000377) which will allows the gases to pass through and extracting the liquids from the foam. A second atomizer may be positioned after the separator and, similarly, additional atomizers and separators can be placed in series. The gas will then cross through the transmission and input compartment and, upon entering the next atomization chamber, the gases will be mixed with other new liquid fluid.

The separation process can also take place in suitable decanter-tanks whereby, upon exiting, the foam coming from the one or more atomizers connected in series are treated by a single centrifugal separator such that the liquid falls back into the tank whereas the gas escapes out.

The operation of this apparatus is based:

1) On the fragmentation carried out by the rotating rods.
2) On the persistence of the process of fragmentation and agitation that avoids the re-aggregation of the micro-fragments and facilitates the renovation of the contact interfaces between different fluids.
3) On the neutralization, attenuation and deviation of the centrifugal vectors generated by the rotation transmitted to the particles, which results in lack an area of low density atomized liquid in the chamber.
4) On the fact that the fluid mixture, atomized and mixed, moves along the chamber continuing to be nebulized and mixed.

Concerning point 1:

The fragmentation depends on a disaggregating action to the impact of the rods on a fluid mass. Therefore, the resistance to the impulsive force is more intense when the mass of the struck body is greater. The brusque increase of pressure in the fluid generates the disintegration of the liquid fluid, and in the presence of gases, forms foam where the density of the foam depends on the liquid-gas ratio and the surface tension of the liquid. Furthermore, the fragmentation increases as the angular velocity of the rotation of the rollers increases.

Thinner rods have a greater penetrating capacity whereas larger rods allow for the application of impacting force to a larger surface area of the fluid, thus producing a greater explosive effect. A compressive and slashing action can be obtained by placing the thin rods close to each other.

Concerning point 2:

The liquid is disintegrated immediately and the disintegrated state is maintained by the action of the rods along the entire atomization chamber.

Concerning point 3:

The particular layout of the rollers and the combs allows for the centrifugal vector of the central roller and partially of the peripheral rollers are neutralized or deviated by the vector of the adjacent rollers. This prevents a fluid with the greatest density (liquid) from accumulating on the outer sides of the atomization chamber, thus leaving the central area to a fluid with the least density (gas).

Figure 8:
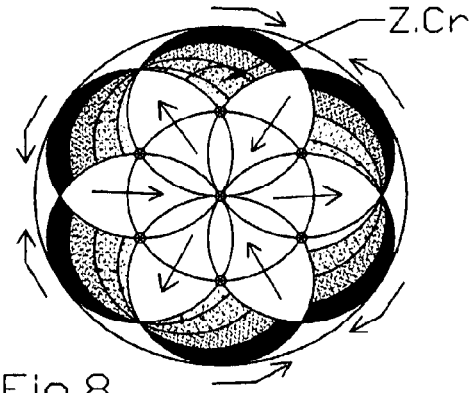
FIG. 8 shows a layout of the atomizer according to the present disclosure, with one functional unit and seven rollers with a critical area indicated Z.Cr.

The external segments of the peripheral circular areas lack contrast with the centrifugal vector. In this area (see FIG. 8—critical area), there is a continuous flow from the center of the roller towards the outside, which ensures the presence of nebulized fluid. Furthermore, in this area, the presence of discs in the peripheral rollers prevent the passage through the outer areas of the axial cylinders, which prevents the fluid with least density (gas) from passing through the external segments with a low concentration of nebulized fluid.

In the central roller, the discs prevent the fluid from passing through areas where the rods of the peripheral rollers cannot reach. The layout and the direction of rotation means that one side of a single peripheral roller creates a rotary drive with the adjacent rollers that leads the fragmented fluid towards the central roller. On the other side, with the other adjacent rollers, it generates a rotary drive that tends to lead the fluid outwards. Using such methods, in the six spaces between the peripheral rollers, a centrifugal flow (3 spaces) and a centripetal flow (3 spaces) are created alternatively, considering the center to be the center of the chamber. Such methods prevents the formation of empty areas. (see FIG. 8)

Concerning point 4:

The fluids are driven along the chamber by pressure generated by their own insertion. Superimposed propellers can be used to obtain an axial pump with multiple propellers by using laminar rods. The result of this process is an intense and fine mixture of two or more fluids, wherein, if one is a gas, becomes a dense foam. The contact surface between the liquids and the gases are broadened significantly. This makes it possible to obtain contact between an enormous number of molecules of the various fluids (gaseous and liquid, in solution or liquid dispersion). in an extremely limited amount of time.

The present phenomenon may be used for various purposes:

1) To obtain rapidly and for large quantities of reagents, the reaction of one or more gases with reagents dissolved in a liquid medium or forming the liquid itself. The reaction may in some cases be spontaneous (e.g.: $CO2+Ca(OH)^2$), and in others may continue after having been set off (fuel+O2).
2) To allow for the capture of particles dispersed in gases (unburnt residues, dusts) by a nebulized liquid.
3) To obtain a heat exchange between a liquid and a gas.
4) The rapid and continuous mixing of fluids can be useful in various sectors such as production, transformation or laboratory processes.

The advantages of the atomizer-mixer according to the invention, compared to those currently in use are:

a) The possibility of obtaining a nebulized mixing column as long as desired.
b) The mixture can run very quickly and at the same time. The molecules of one fluid can come into contact with those of another.
c) The procedure can be carried out in continuous flow.
d) The micro-aggregates cannot cohere in larger aggregates. They are continuously destroyed and reformed.
e) This system does not require injectors that can become clogged, nor the compression of the liquid.

The energy necessary to rotate the rollers is relatively limited, since the viscosity of the nebulized fluid is very low (in the presence of a gas).

In order to suitably dimension the cross-section of the atomization chamber, while also considering the radius of the circular surface area occupied by a single roller, it is necessary to consider the correlation existing between the surface area (open) of the total cross section (Atot.) and the radius (r) of the cross-section, occupied by a single roller (axial cylinder and combs). This correlation is expressed by the following equation:

$$Atot.=r^2\pi+6\{2*[r^2\pi/6-0.5r*\sqrt{(r^2-(0.50r)^2)}]+3(r^2\pi/6-2*[r^2\pi/6-0.5r*\sqrt{(r^2-(0.50r)^2)}]\}.$$

Furthermore, one can also add the surface area occupied by the axes, by the discs and by the rods.

If one wishes to achieve an optimum performance level from this machine, it is necessary to consider that along the atomization chamber, there is a progressive depletion in the active component (a component that could be chemical such as $Ca(OH)^2$ or physical such as thermal energy), and therefore a greater number of contacts between the fluids that one wishes to interact, becomes useless.

The assembly in modules are set up in series, alternated by a same number of centrifugal separators, thereby making it possible to modify (chemically or physically) fluid to interact with the fluid that possesses the modifying component (e.g., liquid to capture the particles, thermal energy, chemical components, etc.) such that the "modifying" fluid or the fluid "to be modified" are both new in each module.

The modifying fluid can exit the atomizer after passing through its modifying component (e.g., hot air that has given its thermal energy to water) such that the modified liquid comes out of the centrifugal separators. Alternatively, the modifying fluid can enter each module again and come out through the centrifugal separator, thus allowing the modified fluid to enter the following module. For example, cold water subtracts thermal energy from the air, thus the water entering each module cold and exiting each module hotter.

Another type of modular assembly is in the parallel layout. The parallel layout makes it possible to avoid using the centrifugal separator at the exit of each atomizer, but instead to use either the end of the collector tube that collects the fluid from all the atomizers, or at the exit from the decanting tank installed above. With this type of assembly, since it is possible to divide the fluids into a number of atomizers, one obtains a reduction in the flow velocity and therefore a longer mixing process. A problem with the area of rarefaction of the nebulized fluid (which is an area in the external slice of the peripheral rollers) appears particularly in the case of chambers with an extensive cross-section and when one wishes to guarantee the interaction of the fluids almost absolutely.

Figure 7:
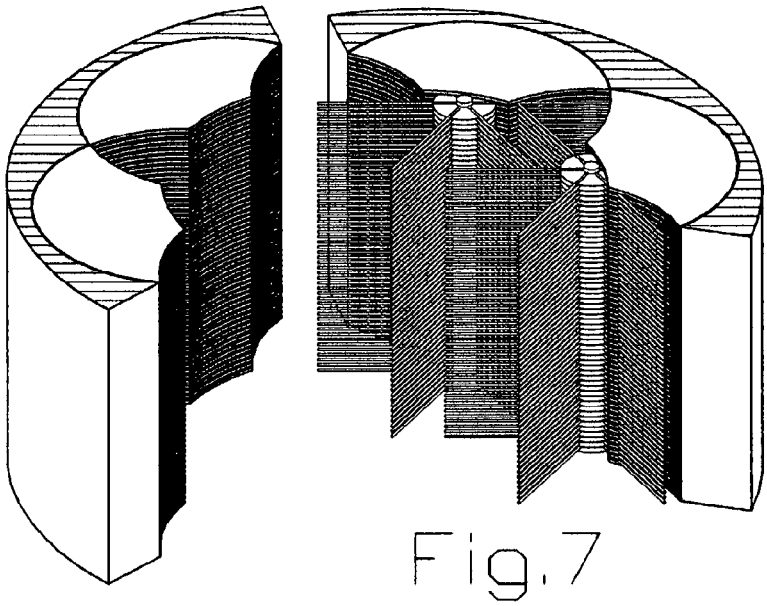
FIG. 7 shows a slice of an atomization chamber with the wall of the container body finned (one of the three parts of the wall has been removed, another has been moved, and only two rollers are shown).
Figure 9:
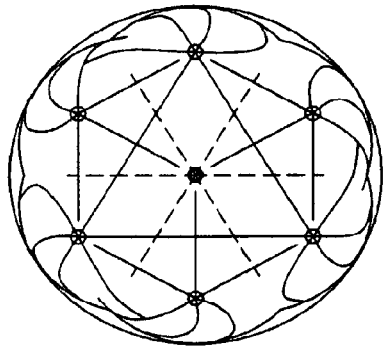
FIG. 9 shows a layout of an atomizer with the wall of the atomization chamber at coinciding arches with semi-elliptical shape and elastic rods.
Figure 10:
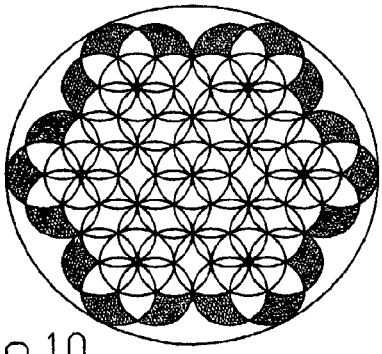
FIG. 10 shows a layout of the atomizer according to the present disclosure, with seven functional units.
Figure 11:
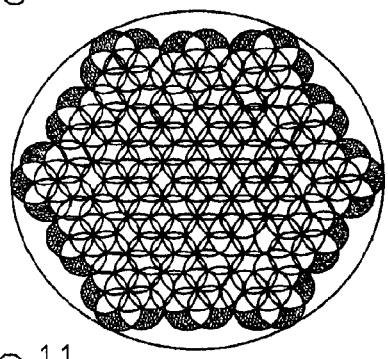
FIG. 11 shows a layout of the atomizer according to the present disclosure, with 19 functional units.

In order to eliminate such problem, with the presence of the discs, one can: 1) Prevent the passage of gas through the critical areas (the external segment of the peripheral rollers) by inserting diaphragm-fins between the planes corresponding with the rods of the comb in the arched wall of the atomization chamber, thereby selectively closing the spaces. Therefore, if one uses rigid rods, the wall are divided longitudinally into three parts and assembled after the rollers have been assembled (see FIG. 7). 2) Flatten the arches in the atomization chamber walls, thereby creating a semi-elliptic arch with the smaller axis towards the center of the chamber. In such case, elastic rods are used for the combs (see FIG. 9). 3) Considering the group of 7 rollers as a functional unit, one can use a higher number (in multiples of 6) of subsets of rollers where one roller is subtracted in the places where two rollers coincide. In this way, one can create a central area where absence of areas of rarefaction are guaranteed. With a peripheral area having very small areas of rarefaction, the peripheral area has an overall surface area that is much smaller than the one that is encountered in a chamber with the same surface area, but a lower number of functional units (see FIGS. 10-11).

The functional performance of the atomizer-mixer depends on the frequency of rotation of the rollers, thus positively affecting the entity of the collisions that the fluid receives from the rods in a given period of time. Therefore, by increasing the frequency of rotation of the rollers, the performance levels of the atomizer-mixer can be improved.

The use for the same surface area of a multiple of six functional units as described above, can have gears corresponding to the single rollers having a smaller circumference. Therefore, by using the same frequency of rotation of the primary gear, an angular velocity of 2.5 times higher can be achieved in the same surface area, by increasing the number of functional units from one to seven, thereby increasing the number of rollers from seven to 43 (see FIG. 10). The resulting rotational speed is 2.5 times greater and secondary gears are 2.5 times smaller.

By increasing the number of functional units from one to 19 (115 rollers), a frequency 4 times greater than the original value can be achieved compared to a single functional unit. For example, a frequency of 10,000 rpm can reach 40,000 rpm. Thus, the person skilled in the art will understand that the entropy of the system will be increased.

The atomizer-mixer of the present disclosure can be used for many applications such as:

1) To mix one or more liquids with a gas, gaseous mixture, smoke, mists, or dusts. Such use can be useful for:

a) Purifying continuous streams of smoke, mists or gases of various origins such as combustion of substrata to obtain thermal energy, electrical energy, mechanical energy, productive processes, transformation processes, destruction of waste, fires, and tobacco smoke. For example, one can mix a smoke containing a pollutant gas (e.g., CO2) with water containing suitable quantities of solute (e.g., $Ca(OH)^2$) which can react with the gas, thus forming a non-gaseous substance (e.g., $CaCO^3$) and retain it in a solution and/or suspension, thus removing it from gaseous phase. At the same time, water (or other types of liquid) will remain solid and/or dispersed liquid particles (e.g., unburnt hydrocarbons) due to its electric charge on the surface. By removing the liquid, for example, by means of the centrifugal separator (see PCT/IT2004/000377), one can eliminate the pollutant components captured by the liquid from the gaseous flow.

b) Purification of dusts in continuous flow (e.g., eliminating dusts in an industrial process or while cleaning using a vacuum cleaner).

c) Facilitating the mixture of air and fuel for combustion (e.g., boiler burners, internal combustion engines).

d) Thermal exchange between a liquid and a gas (e.g., heat extraction from boilers, heaters, fireplaces, gaseous discharges or hot liquids, cooling air (air conditioning units)).

e) Extracting foam oxygenation in fish tanks and swimming pools.

f) Pulverization during mixing processes in industrial or laboratory procedures.

2) To mix two or more liquids rapidly and in continuous flow, preferably in the presence of gas in order to reduce the viscosity.

3) To mix one or more gases rapidly and in continuous flow.

The invention claimed is:

1. A device for spraying and mixing two or more fluids, providing a continuous flow, the device comprising:

a container body having a spray chamber with an inlet end and an opposite end, wherein the spray chamber is formed of a single cavity, the spray chamber having an open end and having a longitudinal axis;

one or more functional units, the one or more functional units further comprising seven rollers, one of the seven rollers being a central roller and six of the seven rollers being peripheral rollers, the peripheral rollers positioned in a circular pattern around the central roller, the circular pattern being a reference circle, the peripheral rollers being spaced apart equidistance from one another, wherein longitudinal axes of the seven rollers are positioned mutually parallel and parallel to the longitudinal axis of the spray chamber, the central roller and the peripheral rollers configured to rotate in a synchronous rotational manner transmitted by a motor, each peripheral roller rotating in an opposite direction relative to adjacent peripheral rollers;

an axial cylinder attached to each of the seven rollers;

six sets of straight and rigid slender rods attached to the axial cylinder, the rods being perpendicular to the longitudinal axis of the roller and coplanar such that the rods form six longitudinal combs arranged to form six 60-degree angles, a space between two consecutive rods on the same comb being substantially equal to a thickness of each rod such that a rod from another comb is able to pass through the space without friction; and a disc on each group of coplanar rods, the disc being arranged on the axial cylinder, wherein a length of the rods, and distance between each peripheral roller and the adjacent peripheral rollers are configured such that the combs on each of the peripheral rollers mesh with the combs of the adjacent peripheral rollers without touching, wherein each set of rods of the central roller being arranged longitudinally such that the rods of the central rollers pass through the spaces between the rods of the peripheral rollers, and vice versa, wherein the rotating rods strike the fluids, the fluids being fragmented, wherein increasing angular velocity of the seven rollers increases the fragmenting, wherein the chamber further comprises side walls formed of six consecutive arches such that the arches are patterned as arcs of circles configured from a shape of the peripheral rollers, wherein an arrangement of the peripheral rollers and the direction of rotation prevents voids from forming.

2. The device according to claim 1, wherein a thickness of the discs on the peripheral rollers are a same thickness as the thickness of the rods, and a radius of the discs being smaller than the length of the rods, the discs being placed on the axial cylinders of each of the peripheral rollers, the discs alternating with the rods in a longitudinal direction.

3. The device according to claim 1, wherein a thickness of the discs on the central roller are a same thickness as the thickness of the rods, and a radius of the discs being smaller than the length of the rods, the discs being placed on the axial cylinder of the central roller, the discs alternating with the rods in a longitudinal direction.

4. The device according to claims 1, wherein the rods of the peripheral rollers pass between the rods of the central roller, skimming the discs thereof, and the rods of the central roller pass between the rods of the peripheral rollers, skimming the axial cylinders thereof.

5. The device according to claim 1, wherein each an upper and lower surfaces of the rods are serrated, the serration being perpendicular to the longitudinal axis of the rod.

6. The device according to claim 1, wherein the length of the rods of the peripheral rollers are approximately 81.65% of the distance between the centers of two adjacent peripheral rollers minus a radius of the axial cylinders of the peripheral rollers.

7. The device according to claim 1, wherein the length of the rods of the central roller corresponds to approximately a radius of the reference circle minus a diameter of the axial cylinders.

8. The device according to claim 1, wherein a radius of the disc is equal to a radius of the reference circle minus a length of the rod and a radius of the axial cylinder.

9. The device according to claim 1, wherein the container body further comprises a transmission and input compartment in communication with the spray chamber.

10. The device according to claim 9, wherein the transmission and input compartment further comprises:

six gears, each of the six gears inserted respectively on the axes of each of the six peripheral rollers, the six gears articulated to one another;

a seventh gear superposed with one of the six gears; and an eighth gear on an axis of central roller, the eighth gear being articulated with each of the six gears.

11. The device according to claim 10, wherein the transmission and input compartment further comprises a transmission joint inserted near an upper end portion of the central roller, a traction of the motor being transmitted through the transmission joint.

12. The device according to claim 9, wherein the transmission and input compartment further comprises input pipes, the input pipes configured to introduce the fluids to be processed.

13. The device according to claim 12, wherein the transmission and input compartment further comprises a manifold, the manifold configured introduce the fluids to be processed.

14. The device according to claim 12, wherein the transmission and input compartment fluidly communicates with an inlet end of the manifold.

15. The device according to claim 1, wherein the rollers and the combs are arranged to enable substantial neutralization of centrifugal vectors of the rollers, thus preventing higher-density fluid from accumulating at a periphery of the spray chamber.

16. The device according to claim 1, wherein the spray chamber further comprises diaphragm fins, the diaphragm fins positioned along the side walls, forming arcuate arches, the diaphragm fins being inserted between planes corresponding to the rods of the combs of each of the peripheral rollers, such that the diaphragm fins selectively close off an outer edge portion of the peripheral rollers, thus preventing fluid from passing between the spaces.

17. The device according to claim 1, wherein the container body is cylindrical.

18. The device according to claim 1, wherein all of the rods have a same thickness.

19. The device according to claim 1, wherein two or more functional units are connected in series.

* * * * *